United States Patent [19]

Searle

[11] 4,138,930

[45] Feb. 13, 1979

[54] PISTON AND CYLINDER MACHINES

[76] Inventor: Russell J. Searle, 20 Park St., Windsor, England

[21] Appl. No.: 574,713

[22] Filed: May 5, 1973

[30] Foreign Application Priority Data

| | | | |
|---|---|---|---|
| May 14, 1974 | [GB] | United Kingdom | 21273/74 |
| May 6, 1974 | [GB] | United Kingdom | 19784/74 |
| Nov. 6, 1974 | [GB] | United Kingdom | 47989/74 |
| Nov. 21, 1974 | [GB] | United Kingdom | 50496/74 |
| Nov. 26, 1974 | [GB] | United Kingdom | 51163/74 |
| Dec. 5, 1974 | [GB] | United Kingdom | 52629/74 |

[51] Int. Cl.[2] ..... F01B 3/00; F02B 57/00

[52] U.S. Cl. ..... 92/70; 91/501; 92/57; 123/43 A

[58] Field of Search ..... 91/501, 499; 92/57, 92/70, 71; 123/43 A, 58 R, 58 B, 58 BA, 18 R, 193 CP; 417/269

[56] References Cited

U.S. PATENT DOCUMENTS

| | | | |
|---|---|---|---|
| 1,117,461 | 11/1914 | Strite | 417/269 X |
| 1,204,892 | 11/1916 | Macomber | 123/58 BA UX |
| 1,315,538 | 9/1919 | Burtnett | 123/58 BA |
| 2,023,466 | 12/1935 | Crowley | 123/193 CP UX |
| 2,261,471 | 11/1941 | Hull | 417/269 |
| 2,957,462 | 10/1960 | Clark | 91/501 X |
| 3,333,577 | 8/1967 | Mongitore | 123/18 R |
| 3,695,150 | 10/1972 | Salzmann | 123/18 RX |

*Primary Examiner*—Carlton B. Croyle
*Assistant Examiner*—Michael Koczo, Jr.
*Attorney, Agent, or Firm*—Haseltine, Lake & Waters

[57] ABSTRACT

A piston and cylinder machine of the kind in which there is a wobble mechanism for reciprocating the piston in the cylinder or an arrangement in which a piston assembly and a cylinder assembly rotate about respective inclined axes so that such rotation is accompanied by relative reciprocation of the piston and cylinder, is provided with a piston having a part which has a surface exposed inside the cylinder to define at least a part of one end of a chamber therein and which, to provide sealing of the chamber, has a peripheral surface forming a sphere. Improved torque transmitting or reacting means for maintaining the correct relative orientation of the piston and cylinder are provided.

19 Claims, 16 Drawing Figures

FIG.1.
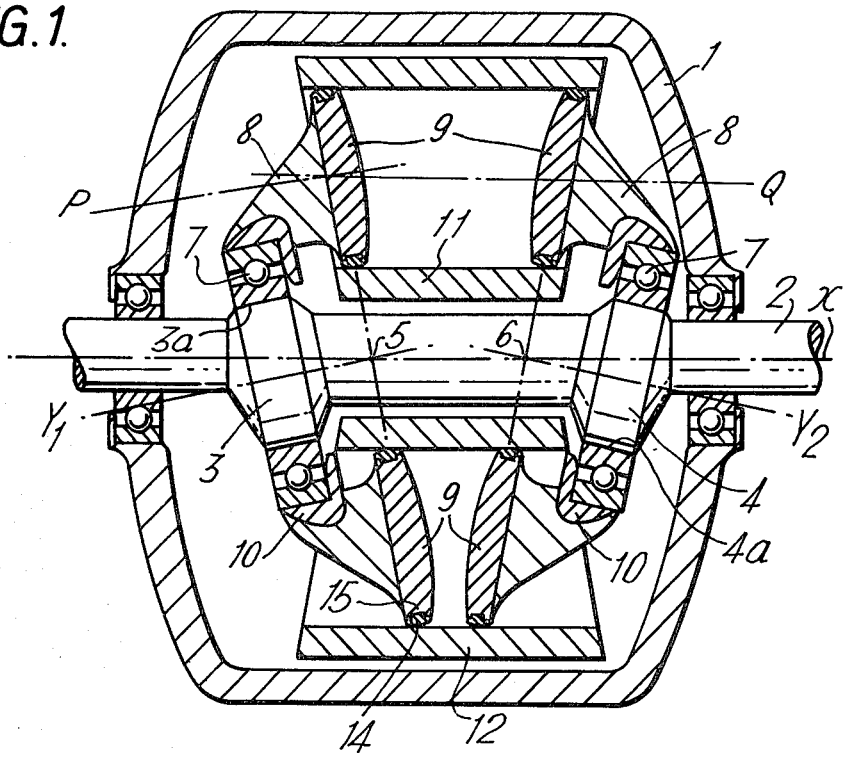
FIG.2.
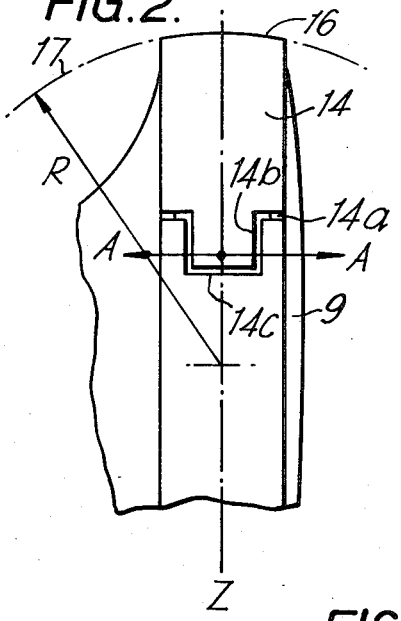
FIG.3.
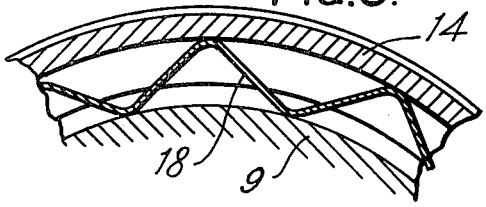
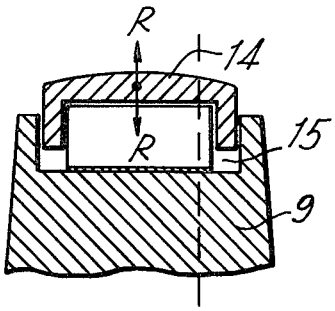
FIG.4.

PISTON AND CYLINDER MACHINES

INTRODUCTION

This invention relates to piston and cylinder machines, for example pumps or compressors and steam or internal combustion engines.

The majority of such machines comprise the well known crankshaft assembly coupled to a piston by way of a connecting rod so that rotation of the crankshaft is accompanied by linear reciprocation of the piston within a cylinder.

However, various designs of machines are known which operate on a wobble mechanism or swash plate principle, or on a principle by which a piston assembly and a cylinder assembly rotate about respective inclined axes so that such rotation is accompanied by reciprocation of the piston within the cylinders. By way of examples, reference may be made to the article "Engines without Cranks" in the periodical "The Autocar" July 23rd 1937, and to British Pat. specification No. 1,102,514.

According to the invention, there is provided a machine comprising a piston and cylinder assembly including a piston and a cylinder having a straight sided bore in which the piston is disposed to form a chamber in the cylinder, a rotatable part, and coupling means connected between said rotatable part and one of said piston and cylinder for causing rotation of the rotatable part to be accompanied by reciprocation of the said one of the piston and cylinder with respect to the other, said reciprocation accompanied by movement of the coupling means along a curved path, and the said piston comprising a part which has a surface exposed to said chamber to define at least a portion of one end thereof and which, to provide continuous sealing of said chamber, has peripheral portions defining a sealing surface in the shape of at least a part of a sphere.

BRIEF DESCRIPTION OF THE DRAWINGS

For a better understanding of the invention, and to show how the same may be carried into effect, reference will now be made, by way of example, to the accompanying drawings, in which:

FIG. 1 is a diagram for explaining the manner of operation of machines according to the invention, FIG. 2 is a part view of a piston sealing ring which may be used in machines according to the invention, FIGS. 3 and 4 are two views of a modified version of the FIG. 2 sealing ring.

The basic operating principle of the practical machines to be described will be explained with reference to FIGS. 1 and 2. In FIG. 1, is shown a machine comprising a housing 1 in which there is rotatably mounted, by means of ball bearing assemblies, a rotatable part with form of a shaft 2. The shaft 2 has fixed to it two inclined eccentric portions 3 and 4 defining respective bearing surfaces 3*a* and 4*a* which are symmetrical with respect to respective axes Y1 and Y2. These axes Y1 and Y2 are coplanar with, but inclined to, the axis of rotation X of the shaft 2, and intersect the axis X at respective points 5 and 6. Fixed around each eccentric portion 3 and 4 is a ball bearing assembly 7 and fixed around each bearing assembly 7 is a piston assembly 8. Each piston assembly 8 comprises two pistons 9 supported on respective sides of the shaft 2 (i.e. above and below the shaft 2 in FIG. 1) by a connecting member 10 to which the pistons 9 are rigidly fixed. The two upper pistons in FIG. 1 face one another and are engaged in a straight cylinder 11 while the two lower pistons also face one another and are engaged in a second straight cylinder 12. The cylinder 11 and 12, and hence also the piston assemblies 8, are prevented from rotating with the shaft 2 by means which are not shown in this Figure. However, the cylinders can move to a limited extent radially with respect to the shaft 2.

Figure 5:
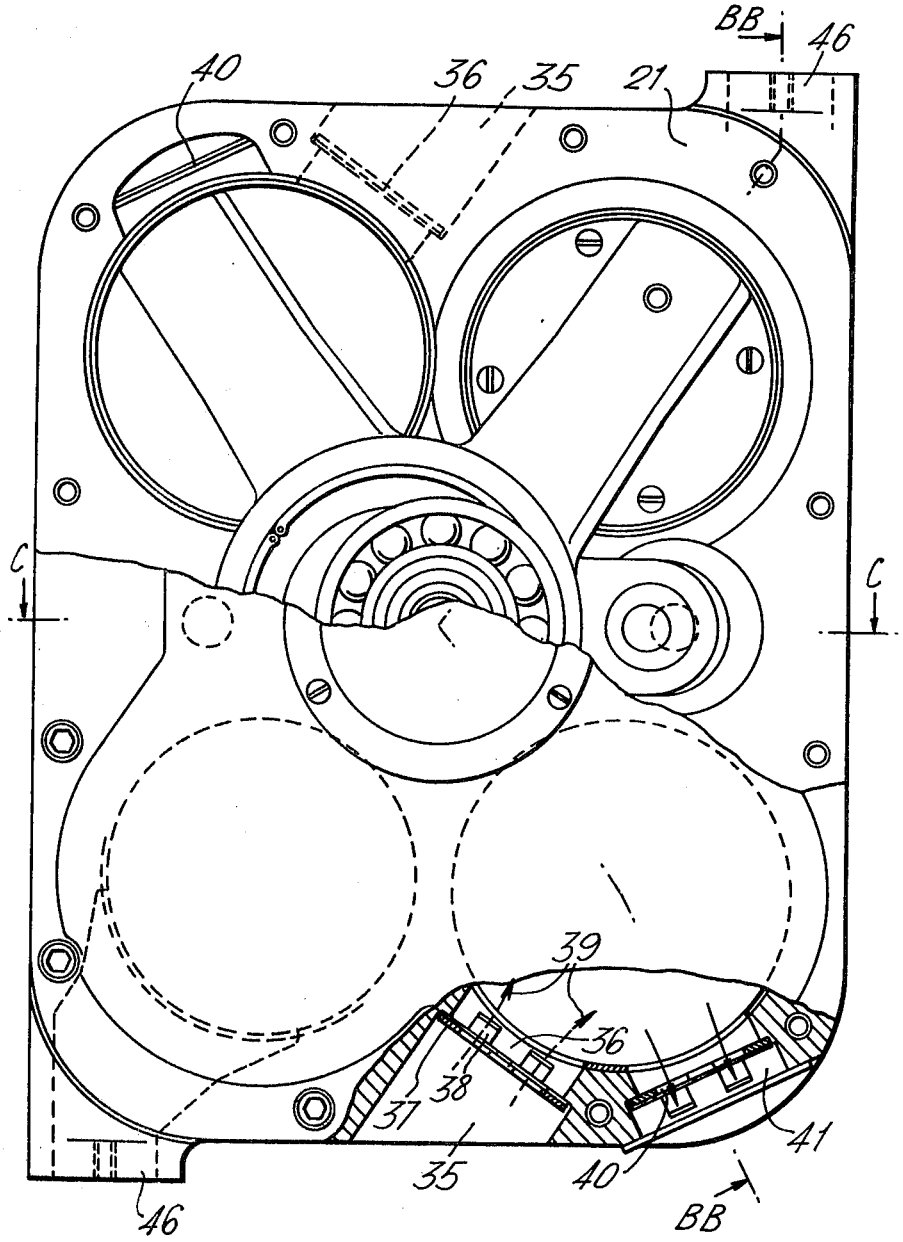
FIG. 5 is a partly sectioned end view of a first internal combustion engine.

As the shaft 2 rotates, the plane containing the axes Y1, Y2 and X will rotate also. In relation to the cylinders 11 and 12, the shaft 2 and the two support members 3 and 4 rotate about the axis X while, in relation to the two piston assemblies 8, the shaft and support members can only rotate about the axes Y1 and Y2 respectively. Since the shaft and support members are in fact rotating about axis X, it will be appreciated that owing to the presence of the first coupling means 3, 7, 10 and the second coupling means 4, 7, 10, such rotation will be accompanied by a reciprocation of the pistons within the cylinders. The two pistons engaged in each cylinder will reciprocate towards and away from each other with the reciprocation of the upper two pistons in FIG. 1 being of opposite phase to the reciprocation of the two lower pistons, i.e. when the two upper pistons are at their closest point of approach, the two lower pistons will be at their greatest distance from each other and vice versa.

Correspondingly, if the pistons are reciprocated, the shaft 2 will be caused to rotate.

As may be seen, as each piston reciprocates, it moves along an arcuate path having a centre of curvature at the point 5 and 6 where the axis X is crossed by the axis Y1 or Y2 of that one of the two eccentric support members 3 and 4 to which the respective piston is coupled. Due to this arcuate movement, the perpendicular distance between the axis X and each piston varies as the piston reciprocates and it is for this reason that the cylinders 11 and 12 are arranged so as to be able to move radially with respect to the axis X. In order to reduce to a minimum the variation in perpendicular distance of the pistons and cylinders from the axis X, the points 5 and 6 are made to lie in planes Z bisecting the respective pairs of pistons which are coupled to the same eccentric portion 4. Each piston 9 comprises a peripheral recess 15 in which there is engaged a resilient split piston ring 14 such that the ring 14 surrounds the periphery of the piston 9 and defines the peripheral sliding surface 16 of the piston, i.e. the surface which slides in engagement with the cylinder bore surface. The piston ring 14 is so shaped that as shown in FIG. 2, the surface 16 forms an equitorial region of a sphere 17 having a radius R equal to that of the bore of the cylinders 11 and 12. The sphere region defined by the surface 16 includes the equitorial plane Z which bisects the sphere and sufficient area on either side of that plane Z so that, throughout the reciprocation of the piston, it remains in contact with the cylinder bore surface at points which are all on the surface 16 and which define a continuous circular line of contact contained in a plane perpendicular to the cylinder axis and forming a circumference of the sphere. Thus, although each piston moves along an arcuate path and hence the angle between its central axis P and the axis Q of the cylinder in which it moves changes between the limits shown in FIG. 1, there is nevertheless maintained a continuous line of sealing contact, around the piston, with the cylinder bore surface so that gas cannot leak past the piston. The ring has a single split 14*a* at one point on its periphery in known manner so that it can expand outwardly against the cylinder bore. It is preferred that the two ends of the ring at the split are not straight so as to form a simple butt joint but are instead formed with a projection 14*b* and a recess 14*c* which interengage to prevent one part of the ring from moving in the direction of arrows A with respect to the other part of the ring.

It will be appreciated that the amount of the change in distance between the pistons and the axis X can be made very small and, because of this, it is not essential that the cylinders 11 and 12 should be able to move radially with respect to the axis X. Instead, the cylinders can be fixed and the piston ring 14 arranged to move with respect to the piston 9 as shown in FIGS. 3 and 4. Here, the piston ring 14 is again spherically surfaced and is engaged in a recess 15 around the periphery of the piston 9. However, the diameter of the floor of the recess 15 is made smaller than the internal diameter which the piston ring has when it is within the cylinder so that the piston ring can move as a whole with respect to the piston in the directions of the arrows R. The piston ring may be held against the cylinder bore by its own resilience but alternatively, as shown in FIGS. 3 and 4, the ring 14 may be hollow and there may be a shaped spring strip 18 interposed between the floor of the recess 15 and the ring 14 so that it is engaged in the hollow interior of the ring and assists or causes the ring to resiliently engage the cylinder bore. A thrust surface of carbon or other self-lubricating material may be interposed between the ring and the piston part 13. Alternatively, the ring itself or the ring seating may be made of self-lubricating material.

By providing suitable ports and valves in the machine of FIG. 1, it can be made into a pump or compressor, or by further providing suitable fuel supply arrangements and an ignition device if necessary, it can be made into an engine.

It will be seen that there could be only one cylinder and two pistons, or there could be more than two cylinders and corresponding pairs of pistons, these being spaced around the shaft 2 appropriately. Instead of the shaft 2 and support members being able to rotate, the shaft and support members could be fixed and the cylinder and piston assemblies rotated around it, this giving exactly the same reciprocating effect as the case when the support member rotates. In the case where the piston and cylinder assemblies rotate, the shaft 2 could be replaced by a pair of shaft members mounted co-axial to respective ones of the axes Y1 and Y2. Then, one or both shaft members can be rotatable so as to form output drive shaft(s), or the drive could be taken from the piston and cylinder assemblies, the two shafts being fixed. Furthermore, the pistons could be replaced by cylinders and the cylinders replaced by pistons, with the cylinders of course reciprocating.

In the case where the cylinders are able to move to take up the changes in centres occasioned by the arcuate movements of the pistons, it may be possible to discard the piston rings and instead have the pistons each made in one piece with its periphery defining the spherical sliding surface 16.

It is not essential that the axes X, Y1 and Y2 should all be coplanar. Instead, the plane containing the axis X and Y1 could be rotated about the axis X in relation to the plane which contains the axes X and Y2. Then, instead of the two pistons in each cylinder reaching their positions of maximum penetration into the cylinder at the same time, the two pistons will be to a greater or lesser degree out of exact phase synchronism, i.e. so that one of the pistons in a particular cylinder will have started to move away from the centre thereof while the other piston in that cylinder is still moving inwardly. This can be advantageous, for example there may be two ports in the cylinder wall, one near each end thereof, which are covered and uncovered by the respective pistons as these reciprocate. The asynchronous movement of the pistons can then be utilised to cause one of the ports to become uncovered at a different time to the other.

Practical embodiments of machines which operate according to the basic principles outlined above will now be described.

Figure 6A:
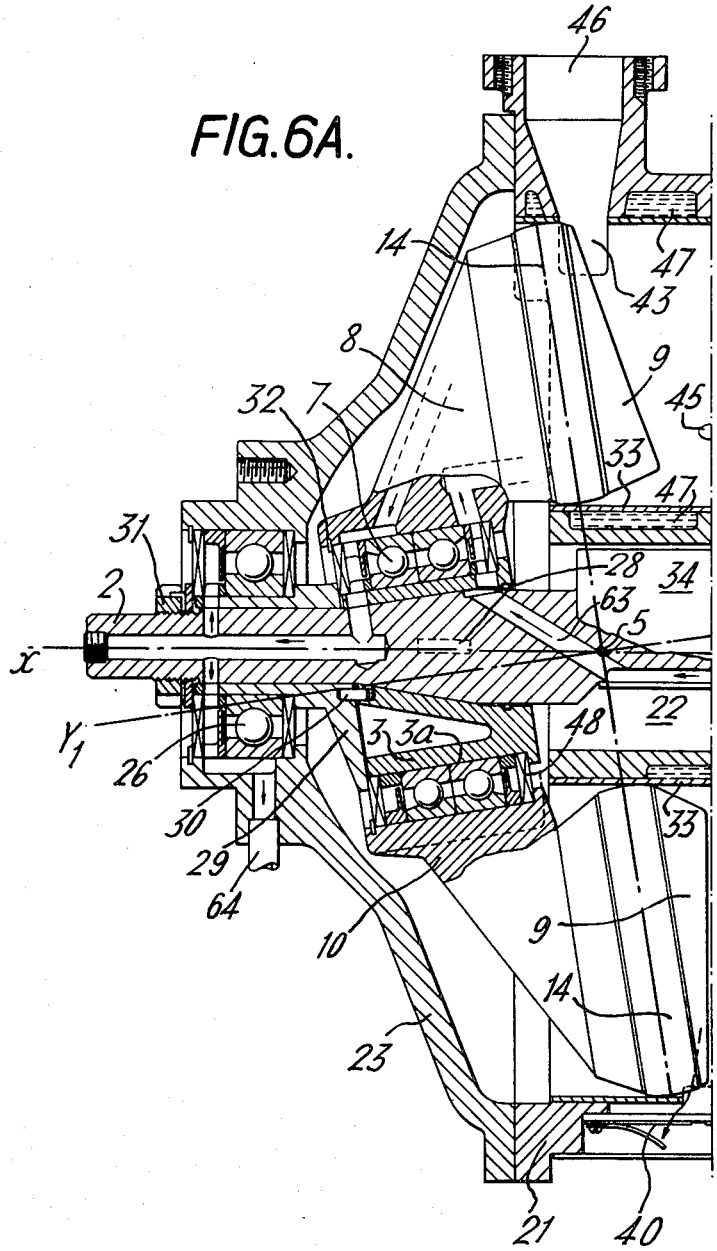
FIG. 6A is a sectional half view taken on the line BB of FIG. 5.
Figure 6B:
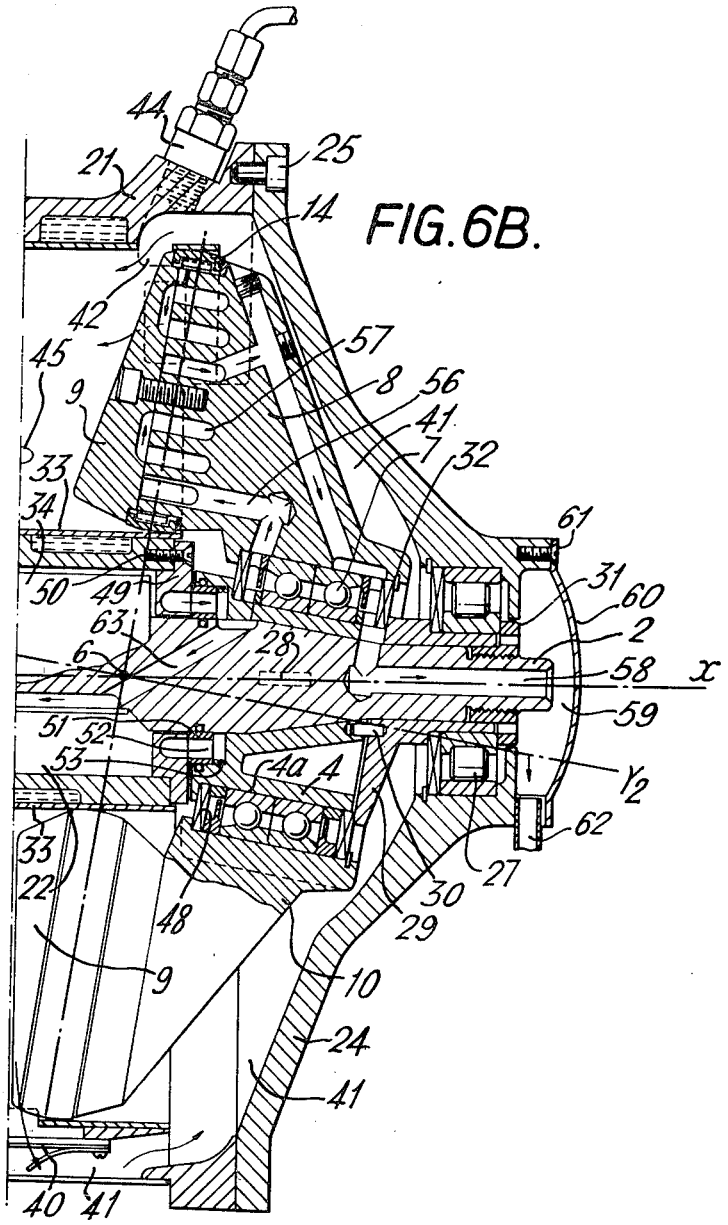
FIG. 6B is a sectional half view taken on the line BB of FIG. 5.
Figure 7:
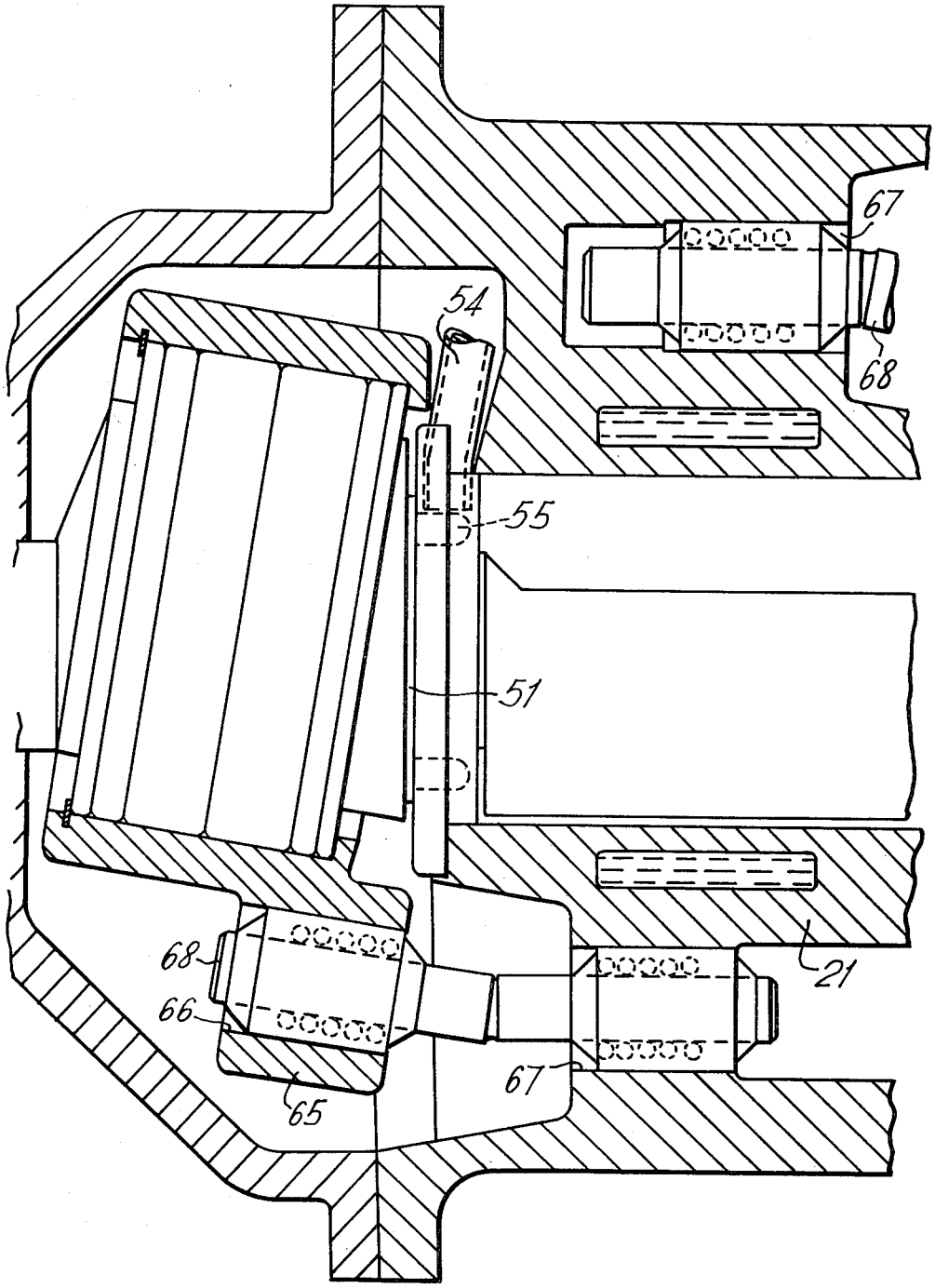
FIG. 7 is a section taken on the line CC of FIG. 5.

The two-stroke fuel injection engine of FIGS. 5 to 7 comprises a cast cylinder block 21 which has in it five parallel bores running from side to side of the block. One of the bores 22 is at the centre of the block and forms a space for a shaft 2 to pass through the block while the other four bores are cylinder bores and are arrayed around, and radially spaced from, the first bore. Two dished side covers 23 and 24 are fixed by means of screws 25 to the side of the block 21. The shaft 2 is rotatably mounted by a ball bearing assembly 26 and a roller bearing assembly 27 which are housed in collar-shaped extensions of respective ones of the side covers 23 and 24. The shaft 2 comprises two tapered portions about which are affixed, by means of key and slot fixings 28, respective inclined and eccentric support members 3 and 4. The eccentric members 3 and 4 define respective bearing surfaces 3*a* and 4*a* which are co-axial with respective axes Y1 and Y2. The axes Y1 and Y2 are coplanar with but inclined to the axis of rotation X of the shaft 2 so that they intersect the axis X at respective points 5 and 6. Respective shaped collars 29 are disposed about the shaft adjacent the outermost sides of the two members 3 and 4 and are keyed thereto by dowels 30. Nuts 31 are screwed onto respective threaded portions at each end of the shaft to hold the bearings 26 and 27, the collars 29 and the eccentric members 3 and 4 in place. Fixed around the eccentric members are respective double-race ball bearing assemblies 7 and fixed around these ball bearing assemblies are respective piston assemblies 8. Each piston assembly comprises four pistons 9 and a connecting member 10. Each connecting member 10 has a central collar part which fits around the respective ball bearing assembly 7 and is held in place by a circlip 32 and has four radially extending arms to the ends of which are rigidly fixed respective ones of the pistons 9. The four cylinder bores are provided with cylinder liners 33 and the four pistons of each piston assembly are slidably engaged in respective ones of the cylinders so that, in each cylinder, there are two pistons whch face each other. As the shaft rotates, the respective pairs of pistons reciprocate towards and away from each other along respective arcuate paths centred on the points 5 and 6 as appropriate. Thus, as in the diagram of FIG. 1, the perpendicular distance between each piston and the axis X of the shaft 2 changes slightly as the piston reciprocates. The cylinders are however fixed, the change in distance of the piston from the axis being accommodated by the means described with reference to FIGS. 3 and 4, namely the pistons are provided with hollow piston rings 14 which are fitted in respective peripheral recesses 15 in the pistons and which have greater internal diameters than the diameters of the floors of the recesses so that the piston rings 14 can move with respect to the pistons, there being a shaped spring member 18 interposed between the floor of each recess 15 and each piston ring 14 so as to push the piston ring outwardly to maintain it in engagement with the bore of the cylinder. As in FIGS. 1 to 4, the peripheral sliding surface 16 of each piston ring 14 forms a part of a sphere having a radius equal to that of the bore of the cylinders so that, throughout the reciprocation of the piston, the piston ring remains in contact with the cylinder bore surface along a continuous circular line of contact to provide sealing between the piston and cylinder.

The eccentricity of the members 3 and 4 is counterbalanced on the shaft 2 by means of a counter-balance member 34 which is positioned within the central bore 22 in the cylinder block 21.

Within the shaft 2, the connecting members 10 and the pistons 9, there are formed passages for the supply of cooling and lubricating oil to the bearings 7, 26 and 27 and the piston rings.

Two of the cylinders, in FIG. 5 the bottom right-hand cylinder and the top left-hand cylinder, are used as air compressing cylinders for charging the other two cylinders, i.e. in FIG. 5, the top right-hand cylinder and the bottom left-hand cylinder, which are used as combustion cylinders to provide the driving power for the engine. Respective inlet manifold ports 35 lead from the exterior of the cylinder block into the charging cylinder by way of respective reed inlet valves 36. Each reed valve 36 comprises an apertured backing plate 37 and a reed plate 38 which is made of resilient sheet metal and which comprises a plurality of leaves or "reeds" lying over the apertures and against the backing plate so that, when the pressure on the backing plate side of the valve is higher than that on the reed plate side, the reeds can bend away from the backing plate 37 to allow gas to pass through the apertures. However, if the pressure is higher on the reed plate side of the valve, the reeds are merely pushed more firmly against the backing plate 37 to keep the apertures closed. Thus, the reed valves 36 allow air from the external atmosphere to pass into the charging cylinders, as shown by the arrows 39 in FIG. 5, but not in the opposite direction. As the two pistons in either charging cylinder move apart, air is drawn into the cylinder via the respective reed valve 36 and then, when these two pistons start to move together again, that reed valve closes so that the air previously drawn into the cylinder is compressed. A further port in each charging cylinder communicates via a reed valve 40, similar to each valve 36 except that it is reversed so as to only allow air to pass out of the cylinder, with a transfer chamber 41 bounded by the side cover 24 and the adjacent side of the cylinder block 21.

Each combustion cylinder has in it two ports 42 and 43, one at each end of the cylinder, which are passed over by respective ones of the pistons 9 in the cylinder as the piston reciprocates. Each pair of ports thus communicate with the interior of the appropriate cylinder between the two pistons therein when those two pistons are at their furthest distance apart. The port 42 in each combustion cylinder leads to the transfer chamber 41 so that, when this port communicates with the cylinder interior, air can enter the cylinder from the transfer chamber 41. Two fuel injectors 44 are mounted in the wall of the block 21 so as to be operable for injecting fuel into the combustion cylinders through the respective ports 42 as the air from the transfer chamber 41 enters. At the same time, exhaust gases from previous combustions within the cylinders can leave by way of the ports 43. After this has happened in one of the combustion cylinders, further rotation of the shaft 2 results in the two pistons 9 in that cylinder moving towards each other so compressing the fuel-air mixture therein. A spark plug 45 projecting into each combustion cylinder and, at or near the time when the two pistons in each cylinder are at their least distance apart, the appropriate spark plug is made to ignite the compressed fuel-air mixture in that cylinder whereupon the two pistons 9 therein are forced apart, this movement being transmitted to the shaft 2 as a rotation thereof. When the two pistons 9 have again moved past the ports 42 and 43 respectively, the exhaust gases can emerge from the engine by way of the port 43 and an exhaust manifold 46 while, at the same time, further fuel-air mixture is drawn into the combustion cylinder by way of the port 42 and so on.

The cylinder block 21 comprises water flow spaces 47 around the cylinder liners 33 which provide a passage for cooling water to flow through the engine.

The bearings 7, 26 and 27 are sealed off from the interior of the casing of the engine by means of annular labyrinth bearing seals 48.

The shaft bore 22 in the cylinder block is sealed by means of an annular plate 49 which is fixed concentrically with the shaft 2 to the cylinder block by means of screws 50. The eccentric member 4 extends close to the plate 49 and sealing between the plate 49 the shaft 2 and the eccentric member 4 is provided by means of an annular carbon face seal 51 which sits within a recess 52 in the eccentric member 4. Between the base of this recess 52 and the carbon face seal 51 there is provided a spring 53 which tends to push the carbon seal 51 against the plate 49. The carbon seal 51 is provided with apertures for the distribution of oil from the fixed part of the engine to the aforementioned oil supply passages within the rotating shaft 2 and the eccentric members 3 and 4. Such oil enters the engine by way of a conduit 54, seen in FIG. 7, which leads to an annular groove 55 formed in the plate 49 and open at that surface of the plate 49 which abuts the carbon seal 51. The oil can thus pass through the apertures within the carbon seal 51 to the bottom of the recess 52 within the eccentric member 4 and then to passages 56 within the shaft 2 and the eccentric member 4. The passages within the eccentric member 4 feed the bearing assembly 7 fixed thereto and also oil flow passages 57 within the associated piston assembly 8 which lead oil through the pistons 9, some of the oil being led from these passages out to the piston rings 14. From the pistons associated with the eccentric member 4, the oil is led by further passages back to the associated bearings 7 and thence via a passage 58 within the shaft 2 to a space 59 formed between the side cover 24 and a dome shaped plate 60 fixed to this side cover by screws 61. Oil is led from the space 60 by way of an oil outlet conduit 62. Oil is also able to pass from the space 60 to the shaft bearing 27. Also, from the recess 52, oil is led via a passage 63 within the shaft 2 to the bearing 7 and piston assembly 8 associated with the eccentric member 3, to the shaft bearing 26 and to a further oil outlet conduit 64.

It will be appreciated that the piston assemblies 8 cannot rotate with the shaft 2 because the pistons are engaged within the fixed cylinders. However, if the cylinder assemblies were the only means preventing the piston assemblies from rotating, such tendency to rotate would result in transverse loading between the pistons and the cylinders especially when the engine is supplying high torque, e.g. during acceleration. For this reason, additional restraining means is provided to prevent this tendency for the piston assemblies to rotate. Such restraining means can be seen in FIGS. 5 and 7. It comprises a lateral extension 65 of each piston assembly connecting member 10 and through each extension 65 is formed a bore 66 having an axis which is parallel to the axis of the associated one of the eccentric members 3 and 4. Further bores 67 are formed in the fixed cylinder block opposite respective ones of the bores 66. A cranked rod member 68 extends between and into each two opposite bores 66 and 67 and ball bearings are interposed between the ends of the rod and the walls of the respective bore so that each rod 68 can rotate with respect to the cylinder block 21 and with respect to the appropriate lateral extension 65 and can also move linearly in the axial directions of the bores 66 and 67 to these parts 21 and 65. Each cranked rod member forms, in effect, a constant velocity torque reactor, rotation of the shaft and corresponding reciprocation of the pistons, being accompanied by corresponding rotation and reciprocation of the cranked rod.

Figure 8:
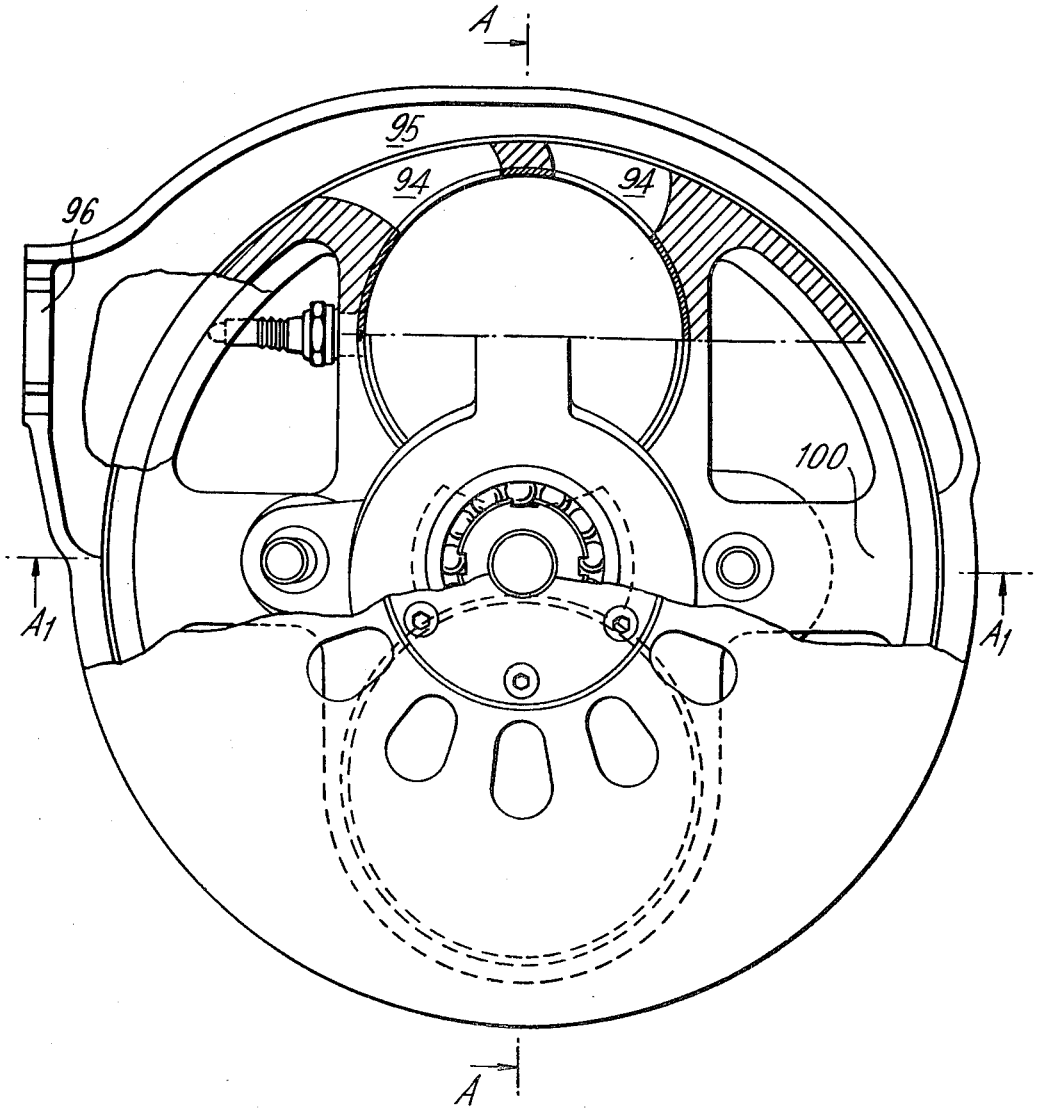
FIG. 8 is a partly sectioned end view of a second internal combustion engine.
Figure 9:
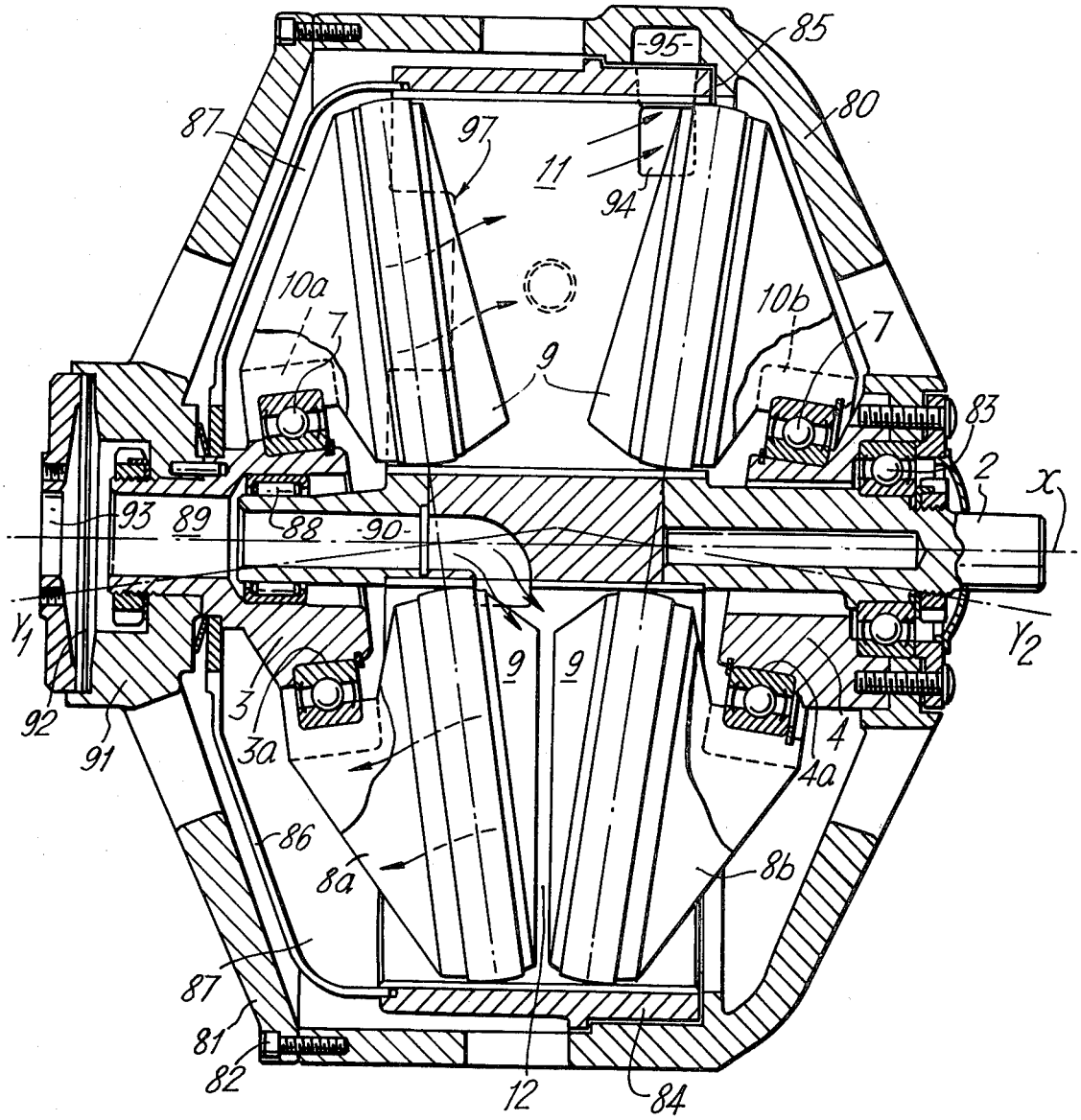
FIG. 9 is a section on the line AA of FIG. 8.
Figure 10:
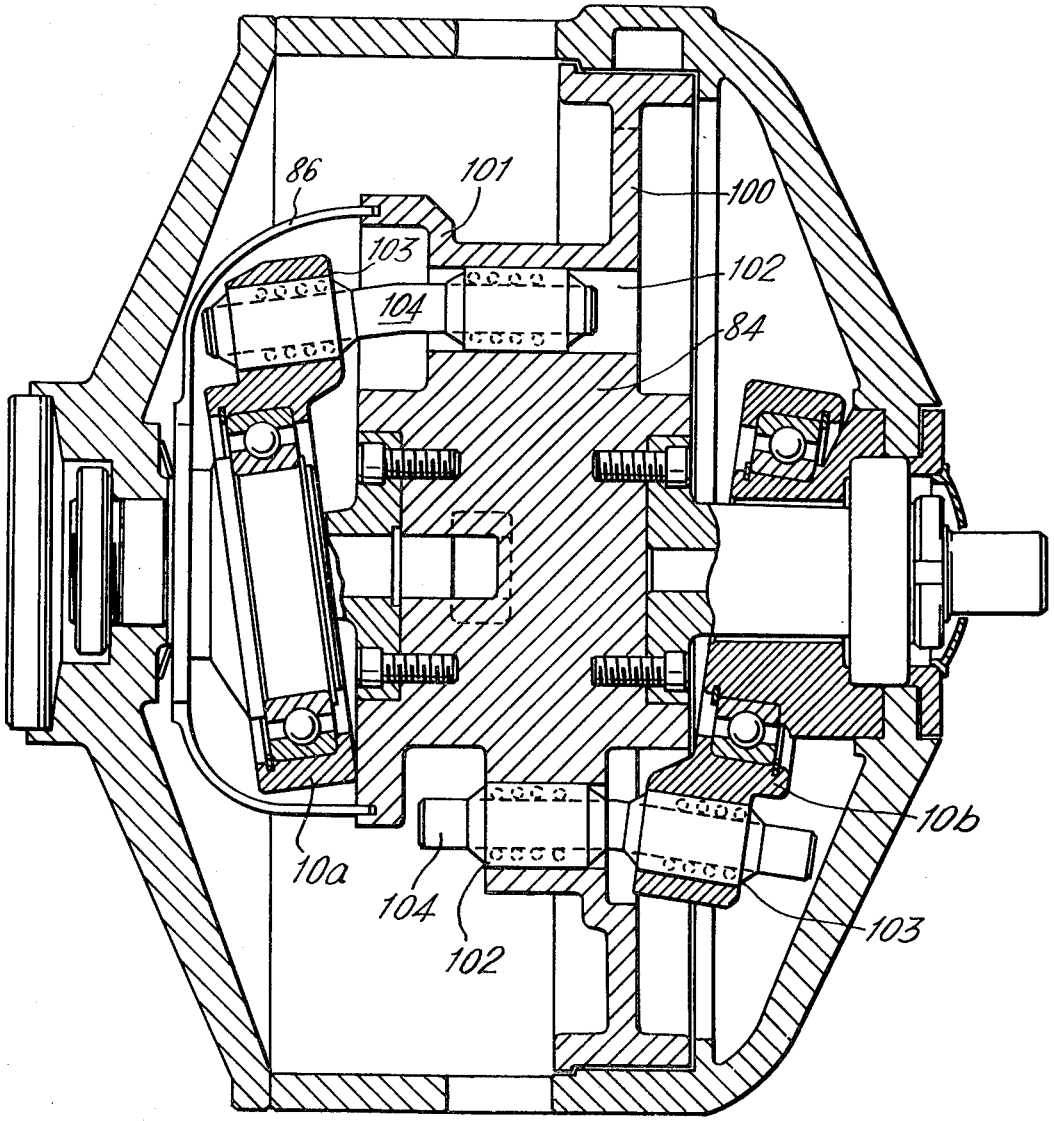
FIG. 10 is the same view as FIG. 9 except that the rotary part of the engine is rotated through 90°, i.e. from A1 A1 in FIG. 8 to AA.
Figure 11:
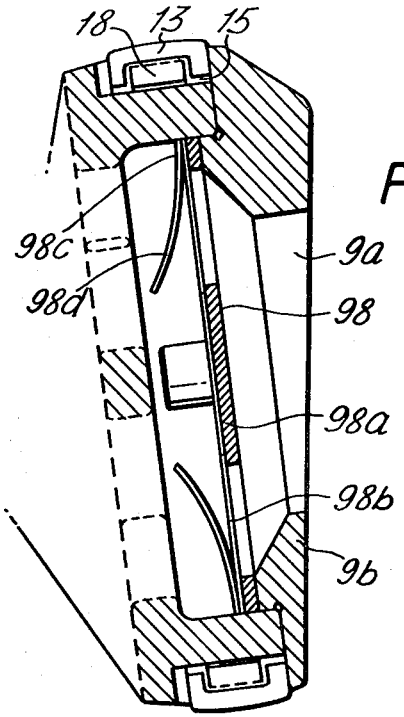
FIG. 11 is a sectional view of a piston used in the engine of FIGS. 8 to 10.

The engine of FIGS. 8 to 11 has two cylinders 11 and 12 one of which 11 is used as a combustion cylinder and the other of which 12, i.e. the lower one in FIG. 9, is used as a charging cylinder. The engine comprises a cup-shaped casting 80 forming a main casing with a dish-shaped side cover 81 affixed to the open end of the casting 80 by means of Allen screws 82. A shaft 2 extends from the base of the cup-shaped casting, where it is supported by a ball bearing assembly 83, into the engine so that its inner end is near the side cover 81. The side cover 81 and the base of the casting 80 have fixed to them respective inclined and eccentric support members 3 and 4 which extend into the casing and which define respective circular bearing surfaces 3*a* and 4*a* co-axial to respective ones of two axes Y1 and Y2 which are coplanar with but inclined to the axis X of the shaft 2. Around the bearing surfaces 3*a* and 4*a* are fixed respective ball bearing assemblies 7 around the outer races of which are fixed respective piston assemblies 8*a* and 8*b*. The piston assemblies 8*a* and 8*b* comprise respective connecting or "bridging" members 10*a* and 10*b* and pistons 9 which are rigidly attached to the bridging members on respective sides of the shaft 2. Two of the pistons, i.e. the upper two pistons in FIG. 9, face one another and are engaged within the combustion cylinder 11 and the other two pistons, i.e. the lower two pistons in FIG. 9, also face one another and are engaged in the charging cylinder 12. The cylinders 11 and 12 are formed in a cylinder block 84 which is fixed to, and rotates with, the shaft 2. On one side, the right hand side in FIG. 9, the cylinder block 84 extends close to an inwardly extending annular flange 85 projecting from the inside surface of the cup-shaped casting 80. On the other side, the left hand side in FIG. 9, is a cup-shaped sheet metal side cover 86 which is fixed to the cylinder block 84 and the wall of which lies between the piston assembly 8*a* and the side cover 81 so as to form a closed spaced 87 which contains the piston assembly 8*a*. The eccentric member 3 is bored through so as to form a housing for roller bearings 88 which support the inner end of the shaft 2 and so as to form an air and fuel mixture inlet passage 89 which communicates with a passage 90 in the shaft 2 leading to the charging cylinder 12. The outer end of the eccentric member 3 extends through the side cover 81 to the interior of a cup-shaped external flange 91 which leads via a reed valve 92 to an air and fuel inlet manifold 93. The combustion cylinder 11 is formed with an array of exhaust ports 94 which, when the upper right-hand piston 9 in FIG. 9 is at its greatest distance from the centre of the cylinder, are uncovered so that exhaust gases can leave the cylinder and then pass by way of an annularly extending recess 95 formed in the interior surface of the casting 80 to an exhaust manifold 96. At the other end of the combustion cylinder 11 there is an inlet port 97 which is uncovered when the upper left-hand piston in FIG. 8 is at its maximum distance from the centre of the cylinder 11 so as to allow air and fuel mixture to enter the cylinder 11 from the closed space 87. The left-hand (FIG. 9) piston in the charging cylinder 12 is formed with ports 9*a*, is hollow and has a removable crown 9*b* as seen in FIG. 11. This piston contains a reed valve 98 which, like the previous valves, comprises an apertured backing plate 98*a* and a reed plate 98*b*, and which allows fuel air mixture compressed within the cylinder 12 to pass out of the cylinder into the space 87. The valve 98 also comprises a rigid plate 98*c* formed with leaves 98*d* which curve away from the reed plate 98*b* to form abutment surfaces for preventing the reeds of the reed plate 98*b* from bending too far away from the backing plate 98*a*. As the cylinder block 84 rotates, the input terminal of the spark plug periodically closely passes an electrode (not shown) fixed, in an appropriate circumferential position, to the inside surface of the casting 80. A High voltage is applied to the electrode by way of an input terminal and a further spark is formed at the electrode gap of the plug thus producing ignition of the fuel air mixture within the combustion cylinder.

The cylinder block 84 comprises a fly wheel part 100 having an T-shaped girder section and a circular periphery, and a part 101 to which the side cover 86 is fixed. In this part 101 there are formed two bores 102 and each piston assembly bridging member 10*a* and 10*b* comprises a corresponding bore 103 opposite a respective one of the bores 102 in the part 101. Between each pair of corresponding bores 102 and 103, there extends a cranked rod 104 with ball bearings between the walls of the bores and the ends of the rods in each case. The rods 104 form torque transmitting members which ensure that the piston assemblies rotate with the cylinder block without substantial loading between the pistons and the cylinder walls.

As the charging pistons move to maximum separation, air and fuel mixture is inhaled through the inlet reed valve 92 and the inlet passage 90 into the charging cylinder 12. As these two pistons move together again, the air and fuel mixture is discharged via the reed valve 98 within the left-hand (FIG. 8) charging piston to the closed space 87 and thence via the inlet port 97 into the combustion cylinder 11. Simultaneously the burnt charge which was previously within the combustion chamber passes via the exhaust ports 94 and the recess 95 are so shaped and orientated that this emission of the exhaust gases gives a turbine effect tending to assist rotation of the cylinder block 84. With the combustion cylinder 11 charged with fresh air and fuel mixture, the two pistons therein begin to come together again and compress the fresh mixture. The aforementioned high voltage electrode is so positioned that, at the proper time, a spark is produced in the cylinder which ignites the fuel air mixture thus forcing these two pistons apart again which, in turn, rotates the engine. As mentioned before, the cylinder block 84 and the shaft 2 both rotate with the piston assemblies. However, in order to result in reciprocation of the pistons the piston assemblies rotate about respective axes Y1 and Y2 which are inclined but coplanar with the axis of rotation X of the shaft 2 and the cylinder block 84. Thus as in the previous engines, the pistons reciprocate along respective arcs centred on the points 5 and 6 where the axes Y1 and Y2 cross the axis X, as well as rotating about the axis X. In order to accommodate this arcuate movement, the engine comprises the same means as are adopted for the engine of FIGS. 5 to 7, i.e. as seen in FIG. 11, each piston is provided with a spherically surfaced hollow piston ring 13 which is seated in a peripheral recess 15 in the piston and there is a spring member 18 between the base of the recess 15 and the piston ring 13. The piston ring can thus move as a whole radially with respect to the piston. The amount of movement required is small, for example about 0.36mm about a mean position for the engine of FIGS. 8 to 11 when so scaled in size as to give a combustion cylinder capacity of about 350cc.

In the engine shown in FIGS. 5 to 7, instead of the cranked rod members 68 coupled between linear rolling bearings, alternative restraining means could be used for preventing the piston and cylinder assemblies from tending to rotate with the shaft. For example, there could be two torque reaction members each connected between a fixed part of the engine and a respective one of the connecting members 10 of the piston assemblies. The torque reaction members may each be pivotally attached to the associated connecting member 10 to allow relative pivoting movement about an axis which passes through the point 5 or 6 where the associated eccentric member axis Y1 or Y2 crosses the axis X, and pivotably attached to the fixed part of the engine for pivoting about an axis which also passes through the point 5 or 6, the two pivoting axes being substantially perpendicular to one another. Each torque reaction member can take the form of a ring positioned concentrically with respect to the shaft 2. The ring can then be pivotably attached to the engine casing at two diametrically opposed points on the periphery of the ring and pivotably attached to the appropriate connecting member 10 at two further diametrically opposed points on the periphery of the ring displaced through a quarter of the circumference of the ring from the first two points.

The engine of FIGS. 5 to 7 could be modified by having, instead of a solid cylinder block with bores therein to form the cylinders, a series of tubular members or sleeves which form separate, fully floating cylinders and which are supported solely by the pistons disposed therein. Then, the restraining means for preventing the pistons and cylinders from rotating can take the form of a thrust absorbing block or pad which is made of resilient material and is fixed to the interior of the engine housing adjacent to and in contact with, one or more of the cylinders, and on that side of this cylinder which is foremost when the cylinder attempts to rotate with the shaft. This side of the cylinder can then be formed with two lugs disposed on either side of the thrust block such that the cylinder can slide radially with respect to the shaft but is prevented, by the engagement of the thrust block with the lugs and the cylinder wall, from moving in the direction of the cylinder axis and from rotating about the shaft axis. It will be appreciated that the ball bearing assemblies 7 could be replaced by other kinds of bearings, it is much preferred however that they should comprise rolling bearings, for example ball bearings as shown, needle bearings or cylindrical roller bearings. Modifications may also be made to the bearings which support the shaft 2, for example these bearings could be positioned between the bearings 7.

Figure 14:
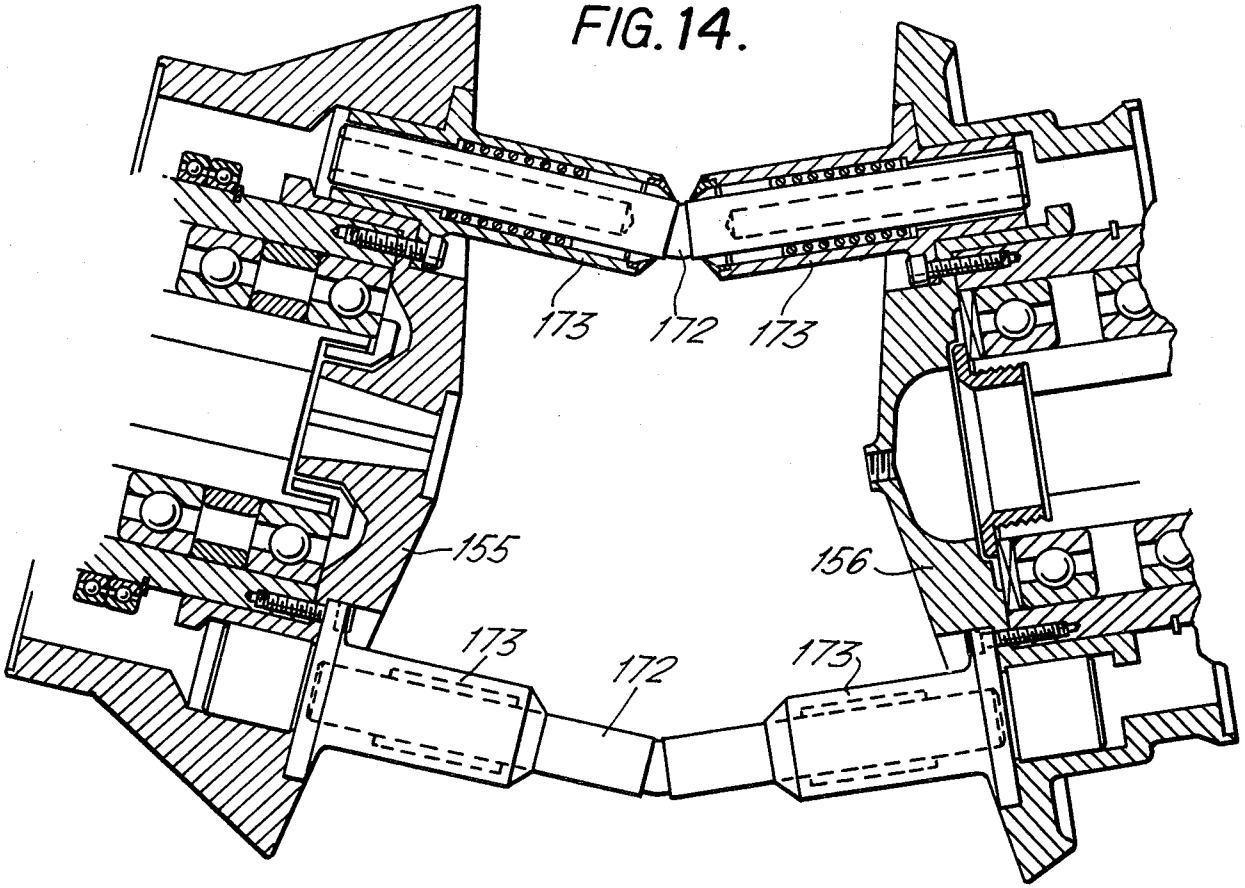
FIG. 14 is a sectional elevation of a torque transmitting means used in the engine of FIG. 13.
Figure 15:
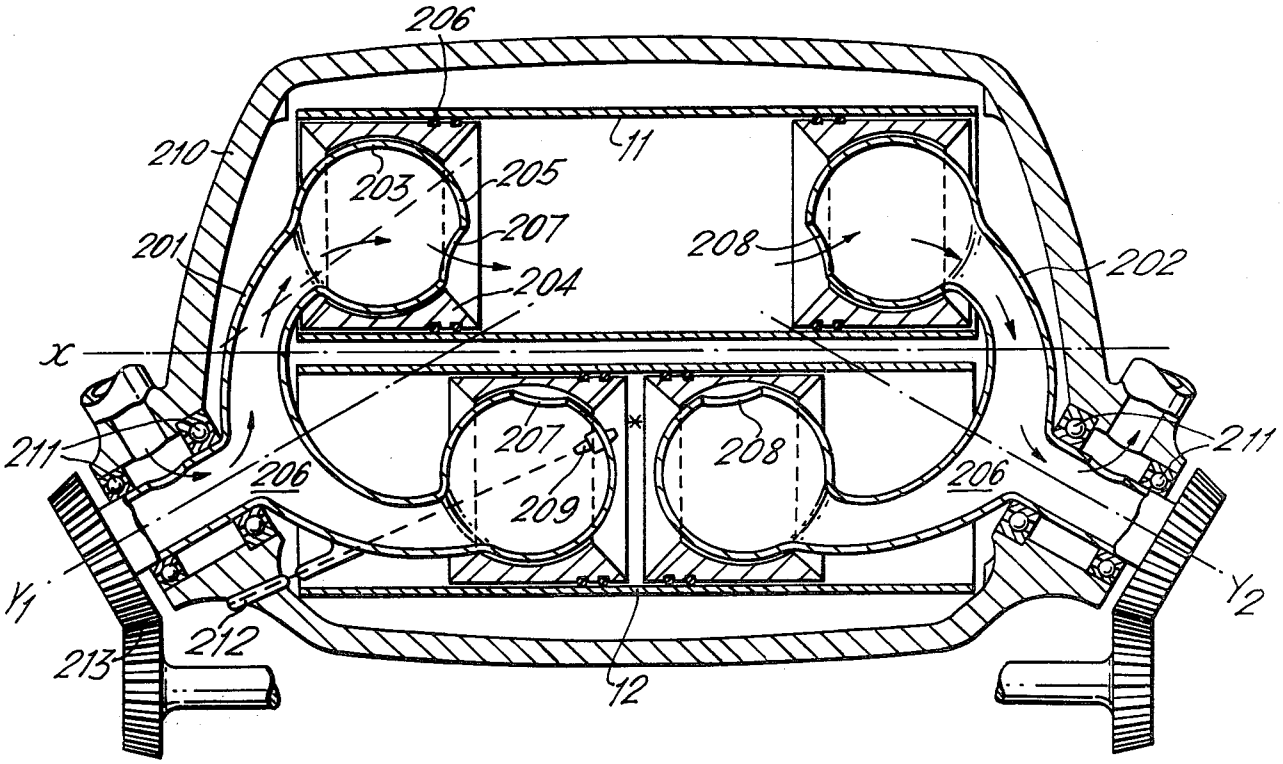

The spherically surfaced piston ring 13 may, in each of the machines shown, be made in two or more interlocking or non-interlocking parts as shown for the interlocking case, in FIG. 14. Put together, the two parts form a single ring with a stepped split around its centre. The parts may be resilient in themselves or, as in FIGS. 5 to 11, may be forced outwards against the cylinder wall by means of a shaped spring ring.

In the rotating cylinder engine, the two piston assemblies and the cylinders could be coupled together by means of an internal or external gear train. In the stationary cylinder engine, there could be gear teeth formed around each side of the cylinder block and interengaging gear teeth formed on an annular member fixed to each piston assembly, such interengagement preventing the tencency for the piston assemblies to rotate in known manner.

Figure 12:
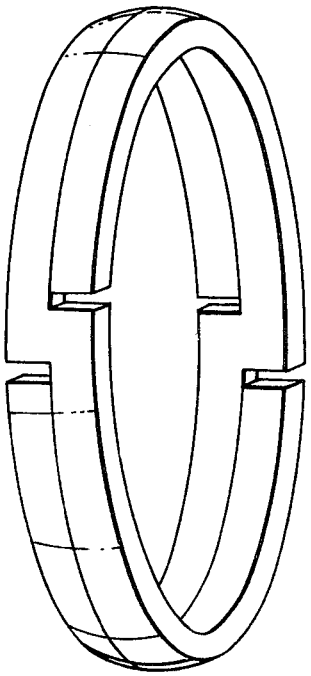
FIG. 12 is a perspective view of a further modified piston sealing ring.
Figure 13:
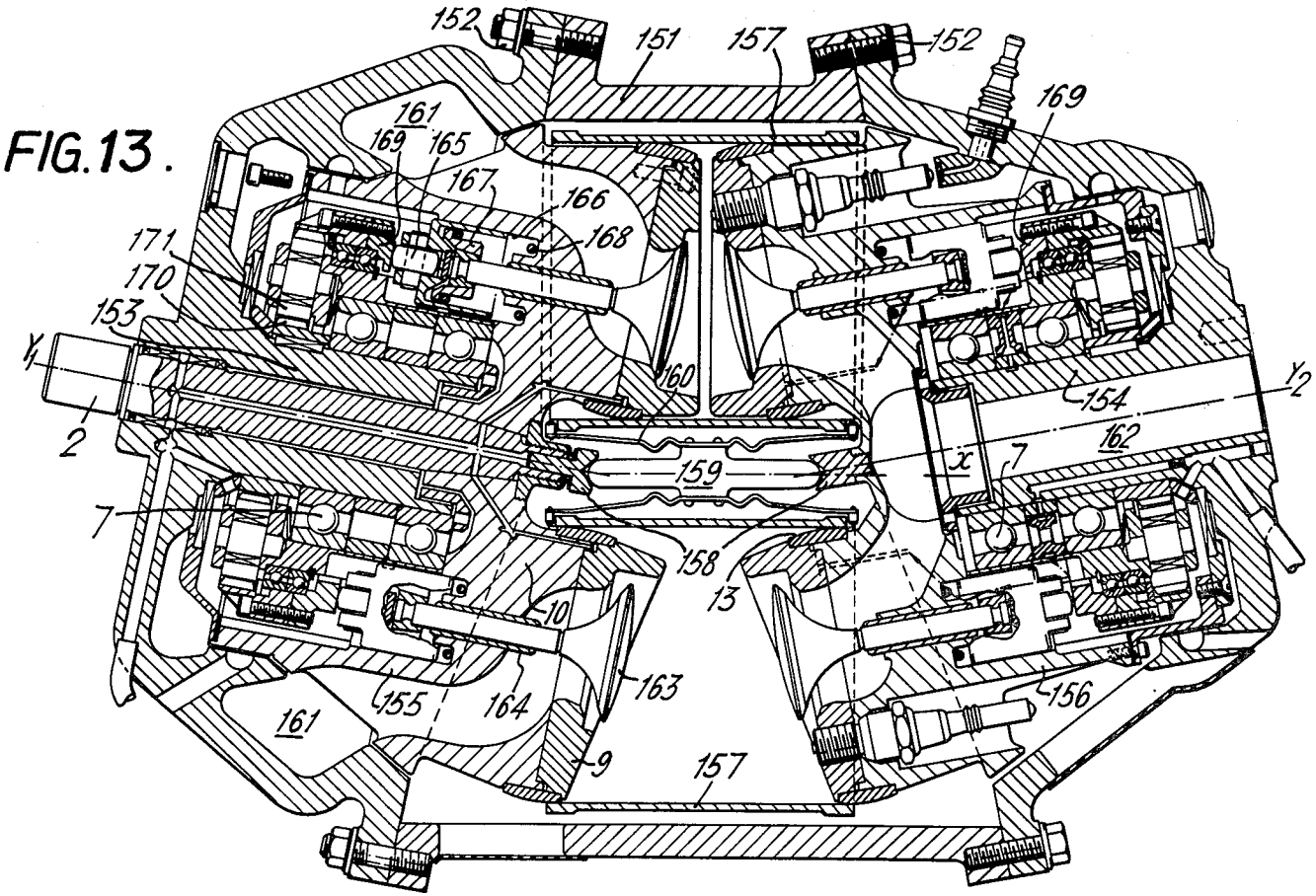
FIG. 13 is a sectional elevation of a third internal combustion engine.

A further engine is shown in FIGS. 12 and 13. This is a 4 stroke engine and comprises a main casing 151 which is formed in three parts, a central, hollow casing part and two cup-shaped side covers which are fixed to the central part by screws 152. The two side covers have respective internally extending support members 153 and 154 symmetrical about respective axes Y1 and Y2 which are coplanar with but inclined to the axis X of symmetry of the engine. Rotatably mounted on the support members 153 and 154 by means of ball bearing assemblies 7 are respective piston assemblies 155 and 156 which each comprise a connecting member 10 and three pistons 9 having spherically surfaced piston rings 13. Each piston of one piston assembly faces a corresponding piston of the other piston assembly and each two pistons are engaged in a corresponding floating cylinder 157. The piston assembly 155 is coupled to a shaft 2 which extends out of the engine through the centre of the left-hand projection 153. At the inner end of the shaft and the inner end of the projection 154 are respective conically recessed portions 158 which support between them an elongate member 159 carrying spring-leaf members 160 which are engaged with respective ones of the cylinders 157 to maintain them in position. Each left-hand piston 9 has a port formed in its crown which leads from the interior of the respective cylinder to an exhaust manifold 161 formed as an annular recess within the left-hand side cover. The right-hand pistons in FIG. 13 also have ports which communicate with a manifold 162 formed as a bore within the projection 154. Fuel air mixture from an external source (not shown) is drawn into this manifold 162 and thence via the ports in the right hand pistons to the combustion chambers in the cylinders. The ports in the piston crowns are closed off by means of poppet valves 163 which are each supported in a valve guide tube 164 in the respective piston. The valve rod in each case extends through the valve guide and its end engages a respective roller type tappet 165 which slides within a corresponding bore 166 formed in the appropriate bridging member. The end of each valve rod has fixed to it a collet 167 between which and the base of the respective bore 166 acts a valve spring 168 to keep the valve normally closed. Supported around respective cylindrical portions of the piston assemblies by means of ball bearings are respective cam rings 169 having respective annular cam faces which engage with the tappets 165 to operate, i.e. open, the valves. Each cam ring is rotated, at a different speed to that of the piston assemblies, by means of planet gear wheels 171 mounted for rotation on the piston assembly and engaged between a stationary sun gear 170 fixed concentrically to the bearing projection 153 and gear teeth formed in the interior surface of the cam ring. The cam rings rotate at one and a half times the speed of the piston assemblies thus opening the exhaust and inlet valves associated with the pistons once in every two revolutions of the assemblies. In order to ensure that the two piston assemblies rotate together, i.e. so that the two opposed pistons in each cylinder remain aligned, the two piston assemblies are coupled together by two cranked rods 172 the ends of which, as shown in FIG. 14, are engaged in respective tubular members 173 fixed to the piston assemblies with ball bearings interposed between the rod ends and the walls of the tubular members 173 so that the rods can slide and rotate with respect to the members 173. The two rods are cranked at an angle corresponding to that between the axes Y1 and Y2 of rotation of the two piston assemblies.

It will be seen that when the two piston assemblies rotate about the axes Y1 and Y2, the cylinders rotate about the axis of symmetry X of the engine, this being accompanied by reciprocation of the pistons in the cylinders as in the previously described machines.

Instead of being coupled together by means of the cranked rods 172, the two piston assemblies could be coupled together by means of an internal or external gear coupling mechanism, or by a universal joint or the like.

Each of the machines described herein could be adapted for steam operation, exhaust ports being provided in the cylinder wall so as to be opened and closed by movement of the pistons and inlet ports also being provided, these being unaffected by the piston movement. Steam then passes via valves external to the cylinder and opening cyclically with rotation of the engine, to the cylinder.

I claim:

1. A machine comprising:

(a) a cylinder having a straight-sided bore spaced from a first axis, (b) a piston assembly including a piston disposed within said cylinder bore to form a chamber therein, the piston having a recess around its periphery, a single piston ring mounted partly in said recess so that the piston ring can move, as a whole, laterally with respect to said piston towards and away from said first axis, the outer periphery of the piston ring having the shape of an equatorial region of a sphere of a radius substantially equal to that of the cylinder bore, the piston assembly further including a connecting member rigidly connected to the piston and restraining means for opposing movement of said piston in relation to said cylinder about said first axis; and (c) a support member mounted to provide relative rotation between the support member and said cylinder about said first axis, the support member being inclined to said first axis along a second axis, said connecting member of the piston assembly being rotatably coupled to said support member to provide relative rotation between the support member and the piston assembly about said second axis whereby relative rotation of the support member and cylinder about the first axis and of the support member and the piston assembly about the second axis is accompanied by reciprocation of said piston along an arcuate path within said cylinder, said equatorial region of said sphere comprising sufficient width on either side of the equatorial plane that, throughout said reciprocation, the piston ring remains in contact with the cylinder wall along a continuous line of contact which is a circumference of the sphere and, along said line of contact, the cylinder wall is tangential to the sphere.

2. A machine according to claim 1, wherein said part of said piston ring is a spring piston ring which is disposed around a member defining the crown of the piston.

3. A machine according to claim 1, wherein said piston ring comprises a plurality of ring-shaped members fitted together.

4. A machine according to claim 1, wherein said support member is mounted for rotation about said first axis and said restraining means is operable for restraining the piston assembly and cylinder from rotating about said first axis.

5. A machine according to claim 1, wherein said support member is rigid with a rotatable shaft having said first axis as its axis of rotation.

6. A machine according to claim 1, wherein said connecting member is coupled to said support member by way of a rolling bearing assembly disposed around the support member.

7. A machine according to claim 1, wherein the said restraining means comprises coupling means connected between a fixed part of the machine and piston assembly.

8. A machine according to claim 1, further comprising spring means between the base of the recess in the piston and the piston ring.

9. A machine according to claim 1, further comprising a further piston assembly which includes a further piston disposed within said cylinder bore and a further connecting member rigidly connected to said further piston, and a further support member between which and said cylinder relative rotation can occur about said first axis, said further support member being inclined to said first axis and to said second axis along a third axis, said further connecting member being rotatably coupled to said further support member to provide relative rotation between the further support member and the further piston assembly about said third axis whereby such relative rotation of the further support member and the further piston assembly about the third axis, of the cylinder and each support member about the first axis, and of the first-mentioned support member and the first-mentioned piston assembly about the second axis is accompanied by reciprocation of the respective pistons towards and away from each other within the cylinder along respective arcuate paths.

10. A machine according to claim 1, further comprising at least one further cylinder having a straight-side bore, the cylinders being arranged in spaced relationship around said first axis and said piston assembly including at least one further piston which is disposed in the bore of said at least one further cylinder to form a chamber therein and to which said connecting member is rigidly connected.

11. A machine according to claim 1, including valve means connected to said cylinder for controlling the flow of gas into and out of said chamber.

12. A machine according to claim 11, wherein said valve means includes a poppet valve and a ring-cam having an annular camming surface which co-operates with the poppet valve to open and close the same.

13. A machine according to claim 11, wherein said valve means includes a port in the wall of said cylinder, which port is passed by the piston as it reciprocates to cover and uncover the port.

14. A machine according to claim 11, wherein said valve means includes a reed valve for controlling the flow of gas into the chamber.

15. A machine according to claim 14, wherein said reed valve is disposed inside said piston.

16. A machine comprising:

(a) a cylinder having a straight-sided bore spaced from a first axis, (b) a first and a second piston assembly each including a piston disposed within said cylinder bore to form a chamber therein between the two pistons, the piston having a recess around its periphery, a piston ring mounted partly in said recess so that the piston ring can move, as a whole, laterally with respect to said piston towards and away from said first axis, the outer periphery of the piston ring having the shape of an equatorial region of a sphere of a radius substantially equal to that of the cylinder bore, each piston assembly further including a connecting member rigidly connected to the piston and restraining means for opposing movement of said piston in relation to said cylinder about said first axis; and (c) first and second support members each mounted to provide relative rotation between the support member and said cylinder about said first axis, the first support member being inclined to said first axis along a second axis, said connecting member of the first piston assembly being rotatably coupled to said first support member to provide relative rotation between the first support member and the first piston assembly about said second axis, said second support member being inclined to said first axis and to said second axis along a third axis, and said connecting member of the second piston assembly being rotatably coupled to said second support member to provide relative rotation between the second support member and the second piston assembly about said third axis whereby such relative rotation of the second support member and the second piston assembly about the third axis, of the cylinder and each support member about the first axis, and of the first support member and the first piston assembly about the second axis is accompanied by reciprocation of the respective pistons towards and away from each other within the cylinder along respective arcuate paths, said machine further including coupling means connected between the two piston assemblies for maintaining them in alignment one with the other, said coupling means comprising an elongated member having two end portions which are inclined to each other at an angle equal to that at which the said third axis is inclined to the said second axis, the two end portions being connected to respective ones of the said two piston assemblies by respective connecting means which each allow relative linear and rotating movements of the elongated member and the respective piston assembly.

17. A machine according to claim 16, wherein each said connecting means comprises a ball bearing assembly.

18. A machine comprising:

(a) a cylinder having a straight-sided bore spaced from a first axis, (b) a piston assembly including a piston disposed within said cylinder bore to form a chamber therein, the piston having a recess around its periphery, a piston ring mounted partly in said recess so that the piston ring can move, as a whole, laterally with respect to said piston towards and away from said first axis, the outer periphery of the piston ring having the shape of an equatorial region of a sphere of a radius substantially equal to that of the cylinder bore, the piston assembly further including a connecting member rigidly connected to the piston and restraining means for opposing movement of said piston in relation to said cylinder about said first axis; and (c) a support member mounted to provide relative rotation between the support member and said cylinder about said first axis, the support member being inclined to said first axis along a second axis, said connecting member of the piston assembly being rotatably coupled to said support member to provide relative rotation between the support member and the piston assembly about said second axis whereby relative rotation of the support member and cylinder about the first axis and of the support member and the piston assembly about the second axis is accompanied by reciprocation of said piston along an arcuate path within said cylinder, said restraining means comprising an elongate member having two end portions which are inclined to each other at an angle equal to that at which the said first axis is inclined to the said second axis, one end portion of the elongate member being connected to the said piston assembly by connecting means which allow relative linear and rotating movements of the elongate member and said piston assembly, and the other end portion of the elongate member being connected to a fixed part of the machine by connecting means which allows linear and rotating movements of the elongate member relative to the fixed part.

19. A machine according to claim 18, wherein each said connecting means comprises a ball bearing assembly.

* * * * *